United States Patent [19]

Marcil

[11] 4,094,263

[45] June 13, 1978

[54] HEEL COMPENSATION SYSTEM

[76] Inventor: Paul M. Marcil, 12117 Phillips Ave., Lynwood, Calif. 90262

[21] Appl. No.: 698,040

[22] Filed: Jul. 19, 1976

[51] Int. Cl.[2] ..... B63B 15/00

[52] U.S. Cl. ..... 114/91; 114/143

[58] Field of Search ..... 114/143, 124, 136.39, 114/91, 93, 135, 144 R, 153, 132

[56] References Cited

U.S. PATENT DOCUMENTS

| | | | |
|---|---|---|---|
| 276,026 | 4/1883 | Goodrich | 114/137 |
| 3,099,976 | 8/1963 | Schwaneke et al. | 114/91 |
| 3,903,827 | 9/1975 | Marcil | 114/143 |
| 3,972,300 | 8/1976 | Adamski | 114/123 |

OTHER PUBLICATIONS

Edson Corporation, Catalog, 1972, p. 27.

*Primary Examiner*—Trygve M. Blix
*Assistant Examiner*—Sherman D. Basinger
*Attorney, Agent, or Firm*—William C. Babcock

[57] ABSTRACT

An improved heel compensation system for use with a sailboat wherein the lateral mast stays or shrouds extending from a pivotally supported mast are directed by a plurality of pulleys to articulate a pivoted heel ballast.

2 Claims, 6 Drawing Figures

HEEL COMPENSATION SYSTEM

BACKGROUND OF THE INVENTION

1. Field of the Invention

The present invention relates to sailboat heel compensation arrangements which, by lateral shifting of a ballasted keel maintains a sailboat in an upright orientation, and more particularly to improvements therein.

2. Description of the Prior Art

Heel compensation of a sailboat has been known in the past. In particular reference is made to my prior U.S. Pat. No. 3,903,827 issued Sept. 9, 1975 wherein a mechanism is described, which by transverse articulation of a sailboat mast articulates transversely and in the opposite direction a ballasted keel. By way of this mechanism, the center of gravity of the boat is laterally displaced relative the center of buoyancy to oppose the heeling moments applied to the sail. As result, the boat hull itself maintains essentially a horizontal position. While my prior patent generally describes such a system I now find certain improvements through which the root stresses of the mast can be significantly reduced while still accomplishing the same purpose.

SUMMARY OF THE INVENTION

Accordingly it is the general purpose and object of my present invention to improve the root bending characteristics of a pivotally supported sailboat mast connected for keel articulation to compensate heeling forces.

Further objects of the invention are to utilize the conventional stays supporting a mast to articulate a pivoted keel.

Yet other objects of the present invention are to provide a heel compensation system which is easy to produce, requires few parts and is therefore reliable in use.

Briefly these and other objects are accomplished within the present invention by pivotally mounting the mast of the sailboat on the boat deck, the freedom of motion around this pivotal mount allowing for lateral articulation of the mast. This pivotal mount supports the root, or the base end, of the mast with the lateral (port and starboard) stays being passed through a set of guide rollers into the interior of the hull. Within the hull the stays are then directed over corresponding pulleys to articulate a laterally pivoted ballasted keel in a direction opposite to the lateral motion of the mast. By way of this arrangement no bending forces are exerted on the root of the mast with the shrouds or stays providing both the mast support function and the force to articulate the keel. The ballasted keel then provides the necessary restoring forces to return the mast to an upright position once the heeling or the side forces are removed from the sail.

DESCRIPTION OF THE SPECIFIC EMBODIMENT

While the following description sets forth the present invention in conjunction with a slooped rigged sailboat such illustration is exemplary only. It is to be noted that various other sailboat configurations can be implemented to take advantage of the invention herein and no intent to limit the scope is expressed by the choice of this example.

Figure 1:
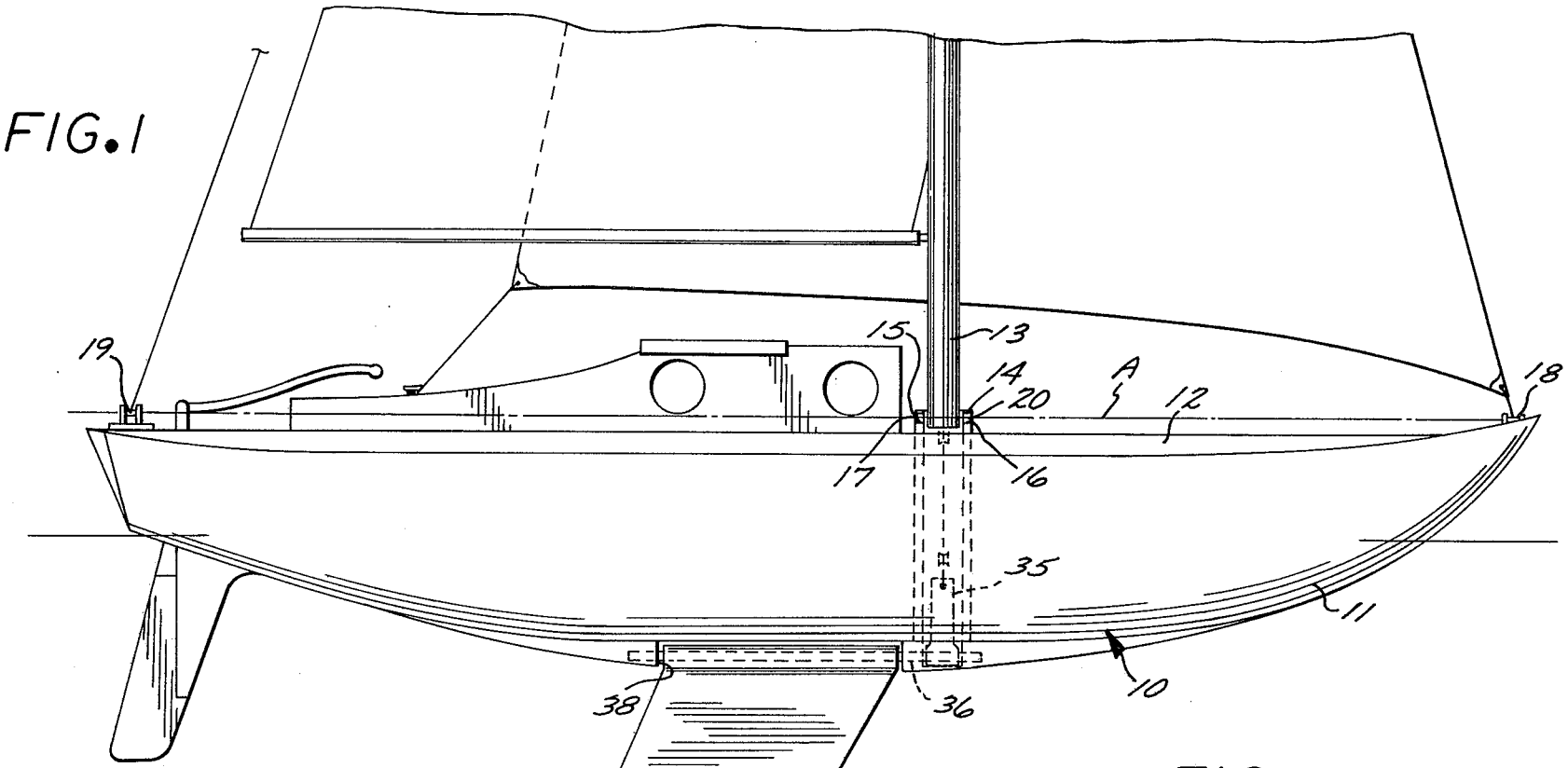
FIG. 1 is a side view illustration of a monohull sailboat incorporating the inventive features disclosed herein.

As shown in FIG. 1 a sailboat, generally designated by the numeral 10, comprises a hull 11 closed on the upper surface by a deck 12 above which a mast 13 is supported. More specifically in order to provide for a rigid structure two vertical members 14 and 15 extend from the hull bottom through the interior of the boat and project upwardly through the deck 12 to form a pair of pivot support bores 16 and 17 axially aligned along a common axis A which also passes through the mounting centers of a fore and aft stay bracket 18 and 19. Received within bores 16 and 17 is a pivot rod 20 which, in turn, pivotally supports the end of the mast 13. In this arrangement, lateral articulation of mast 13 is around the common axis A which also passes through the fore and aft stay brackets. Accordingly as the mast 13 is articulated to either port or starboard no foreshortening occurs of the usual forward or aft stays 21 and 22.

Figure 5:
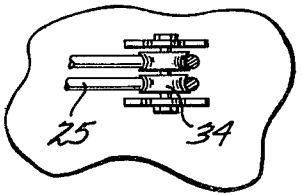
FIG. 5 is a top view detail of a pulley pair useful with the present invention.
Figure 2:
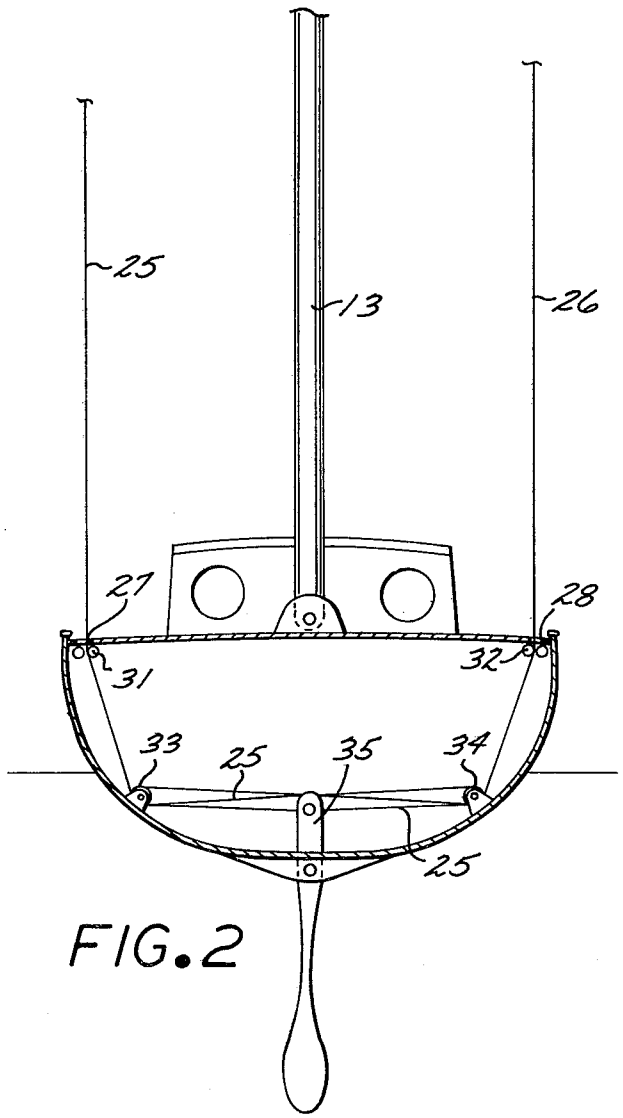
FIG. 2 is an end view in partial section of the monohull sailboat shown in FIG. 1.
Figure 3:
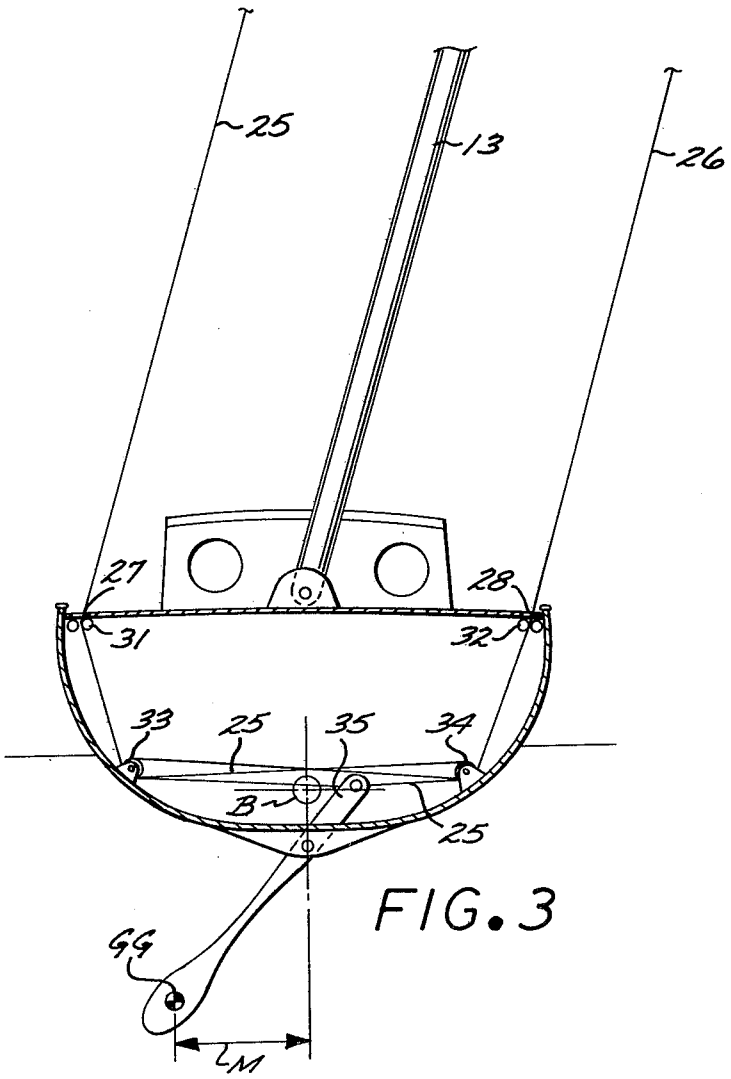
FIG. 3 is a view as shown in FIG. 2 illustrating the articulation of the present mechanism.

As shown further in FIGS. 1, 2, and 3, mast 13 is supported by way of two lateral stays 25 and 26 which pass at the lower ends thereof through corresponding openings 27 and 28 formed at the usual attachment locations in the deck 12. Stays 25 and 26 are then turned around corresponding guide roller sets 31 and 32 disposed respectively below openings 27 and 28 to pass around corresponding pulley sets 33 and 34. As shown in FIG. 5 each pulley set 33 and 34 is identical and is illustrated therefore by way of pulley set 33. Pulley set 33 comprises two pulleys mounted on a common axis and illustrated herein as pulleys 33A and 33B. Stay or shroud 25 can thus be passed around pulley 33A to engage a corresponding pulley 34A on the other set 34 to be returned thereabout to an attachment point on the end of an arm 35. Similarly stay or shroud 26 can be passed around the other pulley (i.e. pulley 34B) in the pulley set 34 to be returned around pulley 33B again to the arm 35.

Figure 4:
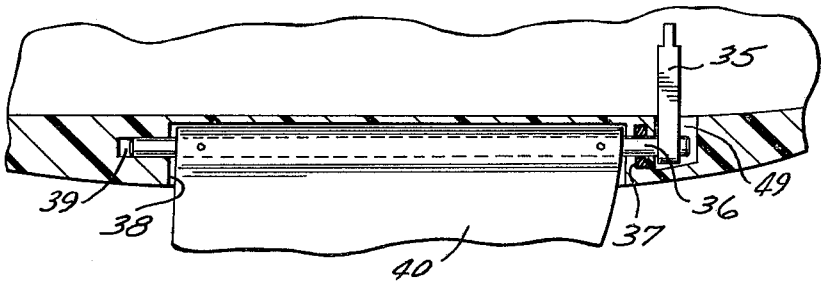
FIG. 4 is a side view detail illustrating the pivotal arrangement of a ballasted keel useful with the present invention.

As shown in FIG. 4, arm 35 extends from the inboard end of a keel support pivot rod 36 which at the forward end passes through a water tight bearing 37 from a keelson pocket 38 formed on the underside of the hull 11 into an interior pocket 49. The other end of the pivot rod 36 is similarly received within a bearing or bore 39 formed on the aft end of the pocket 38. It is contemplated that the arm 35 be secured to the pivot rod 36 by either splined or keyed engagement and the pivotal articulation of the arm therefore is accompanied by the pivotal rotation of the rod 36. Thus as has been described the articulation mechanism extends from keel 40 into hull 11 to be attached to lateral stays 25, 26 extending from second pulleys 33 and 34 and includes arm 35 secured to pivot rod 36 in the interior of hull 11 to extend radially therefrom. Attached to rod 36 is a ballasted keel 40 which will thus be articulated in a direction opposed to the articulation of the end of arm 35, thus accomplishing the heel compensation effect described above.

More specifically by reference back to FIGS. 2 and 3 keel 40 is shown to include a keel ballast center of gravity CG proximate the bottom end thereof which as shown in FIG. 3 will be displaced by a moment arm M from the vertical plane passing through a center of buoyancy B. By way of this arrangement, a moment opposite to the heeling moment applied on mast 13 can be achieved by selected variation of the length of the arm 35 and the radial dimension between the pivot rod 36 and the ballast center of gravity CG. By virtue of this gearing, any practical sail area can be accommodated with relatively small motion in the keel. In addition the gearing gain between arm 35 and the radial ballast dimension insure relatively small motions of the end of arm 35 thus minimizing any geometric foreshortening of the lateral stays 25 and 26 during this pivotal articulation.

Figure 6:
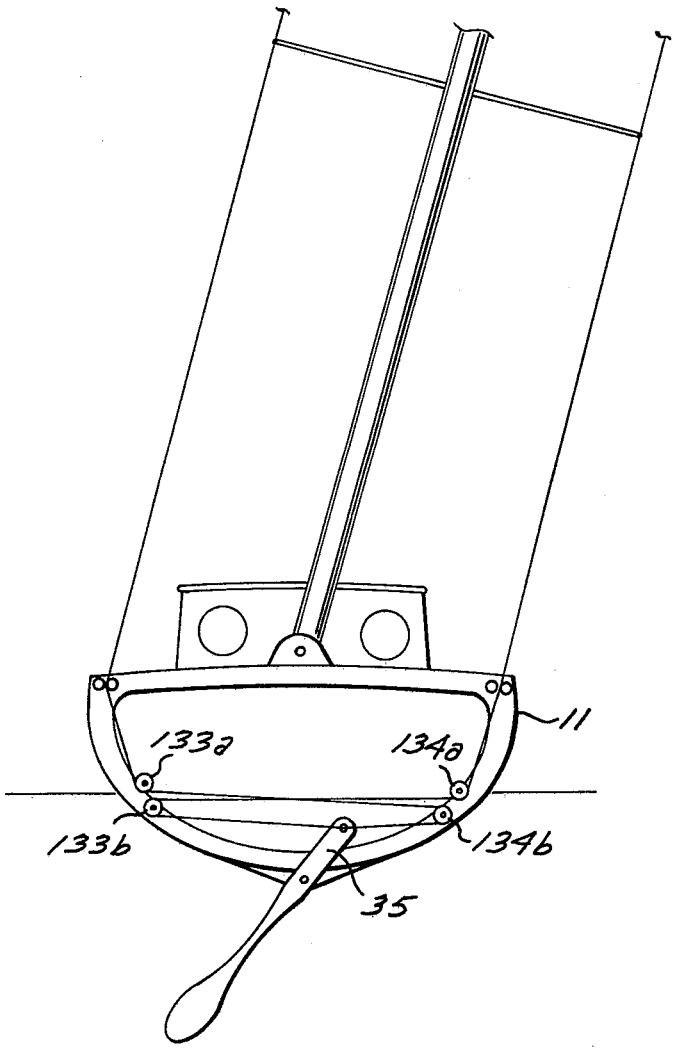
FIG. 6 is a sectional view illustrating yet another pulley arrangement useful herein.

As an alternative embodiment reference should be made to FIG. 6 wherein a staggered arrangement of pulleys accomplishes the same purpose. More specifically two vertically displaced pulleys 133A and 133B are disposed within the hull 11 to provide the function of pulleys 33A and 33B described above. Similarly pulleys 134A and 134B provide the function of the pulley set 34. The advantages of this latter arrangement are to allow for complementary geometric adjustments between pulleys 133B and 134BB and the length of arm 35 and thus achieve a minimal foreshortening of the lateral stays during articulation. Accordingly other than this last pulley arrangement the remaining operative characteristics are the same and reference should be made to the former embodiment for the function of like numbered parts.

Some of the many advantages of the present invention should now be readily apparent. The invention provides by way of convenient stay routing and connection a system which is fully adapted to accommodate any hull buoyancy characteristics and mass concentrations in the keel. This the invention provides in a passive system, requiring few parts which thus make any maintenance thereof convenient to the sailboat user.

Obviously many modifications and variations to the above disclosure can be made without departing from the spirit of the invention. It is therefore intended that the scope of the invention be determined solely on the claims appended hereto.

I claim:

1. In a sailboat assembly including a hull, a mast disposed from said hull, a plurality of fore and aft stays and lateral stays disposed between said mast and said hull for providing support to said mast and a ballasted keel disposed on the underside of said hull, the improvement comprising:

pivotal support means formed on the upper surface of said hull for engaging the lower end of said mast, said pivotal support means having a first axis of pivotal motion aligned in common with the juncture of said fore and aft stays within said hull;

a plurality of first pulleys disposed within said hull respectively along lateral edges thereof for engaging corresponding ones of said lateral stays;

a plurality of second pulleys disposed within said hull in substantial corresponding longitudinal alignment below said first pulleys for engaging said lateral stays directed from opposite ones of said first pulleys;

pivotal attachment means interposed between said hull and said ballasted keel including a second axis of pivotal motion aligned in substantial parallel alignment with said first axis, said pivotal attachment means including a pivot rod extending longitudinally in a pocket formed on the underside of said hull, said pivot rod being secured to said keel in rotation; and, articulating means extending from said keel into said hull to be attached thereat to said lateral stays extending from said second pulleys, said articulating means including an arm secured to said pivot rod in the interior of said hull to extend radially therefrom, whereby lateral articulation of said mast is accompanied by an opposite articulation of said keel.

2. Apparatus according to claim 1 further comprising:

a watertight bearing disposed in said hull around said pivotal attachment means for providing a watertight seal thereabout.

* * * * *